United States Patent [19]

Matthews et al.

[11] Patent Number: 5,072,536

[45] Date of Patent: Dec. 17, 1991

[54] TECHNIQUE FOR DISPLAYING CUSTOM VEHICULAR WHEELS

[76] Inventors: Max M. Matthews, 500 El Rancho #11, McAllen, Tex. 78501; Scott E. Matthews, 6713 N. 14th La., McAllen, Tex. 78504

[21] Appl. No.: 490,927

[22] Filed: Mar. 9, 1990

[51] Int. Cl.[5] ..... G09F 21/04

[52] U.S. Cl. ..... 40/587; 40/621; 301/37 R

[58] Field of Search ..... 40/587, 600, 621, 622; 301/37 I, 37 T, 37 R

[56] References Cited

U.S. PATENT DOCUMENTS

| | | | |
|---|---|---|---|
| 1,733,918 | 10/1929 | Spotswood | 40/587 |
| 2,785,490 | 3/1957 | Fabry | 40/621 |
| 3,481,652 | 12/1965 | Mazerolle | 40/587 |
| 4,058,917 | 11/1977 | Tallon | 40/587 |
| 4,441,762 | 4/1984 | Segal | 301/37 P |
| 4,678,239 | 7/1987 | Matsushita | 40/587 |
| 4,864,860 | 2/1975 | Marzweiler | 40/587 |

FOREIGN PATENT DOCUMENTS

| | | | |
|---|---|---|---|
| 41201 | 2/1988 | Japan | 301/37 R |
| 130401 | 6/1988 | Japan | 301/37 T |
| 970648 | 9/1964 | United Kingdom | 40/620 |
| 425 | 7/1979 | World Int. Prop. O. | 301/37 ST |

*Primary Examiner*—Rodney M. Lindsey
*Assistant Examiner*—F. Saether

[57] ABSTRACT

A series of axial photographs of custom wheels are placed over the conventional steel wheels of a vehicle to display the custom wheels in association with the vehicle. A connector is used to hold the photograph in place. One embodiment of the connector attaches to the wheel by the use of adjustable clips and the photographs are secured to the connector. In another embodiment, the connector drapes over the tire and suspends the photograph in a position covering the wheel.

13 Claims, 2 Drawing Sheets

FIG. 1
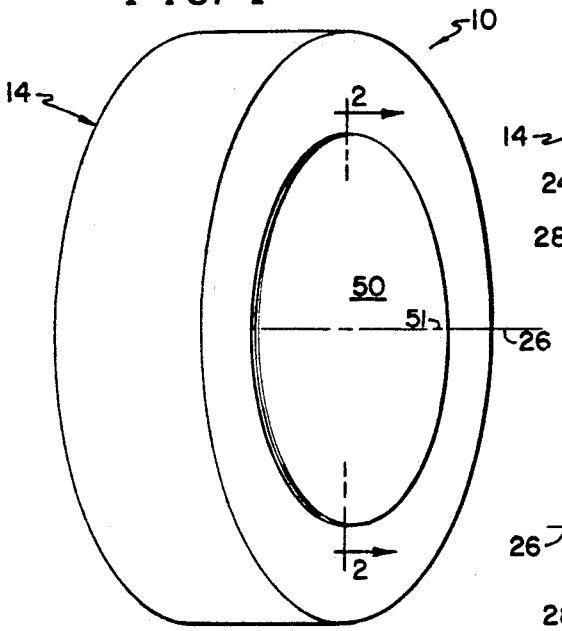
FIG. 2
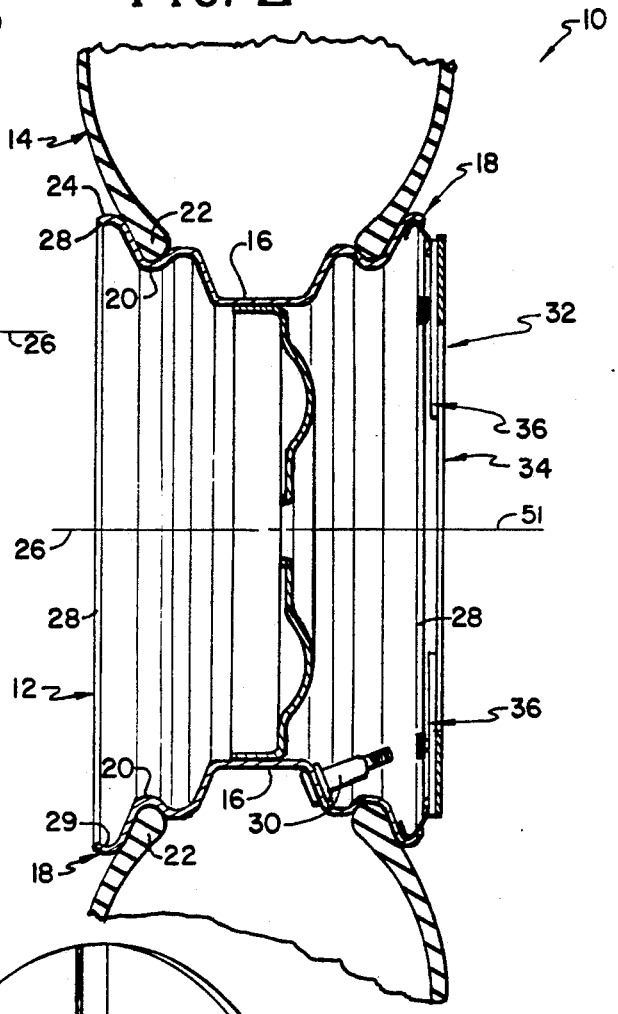
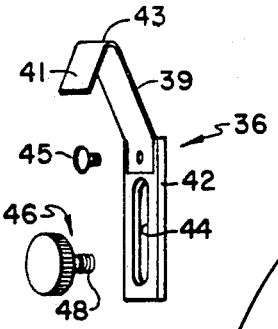
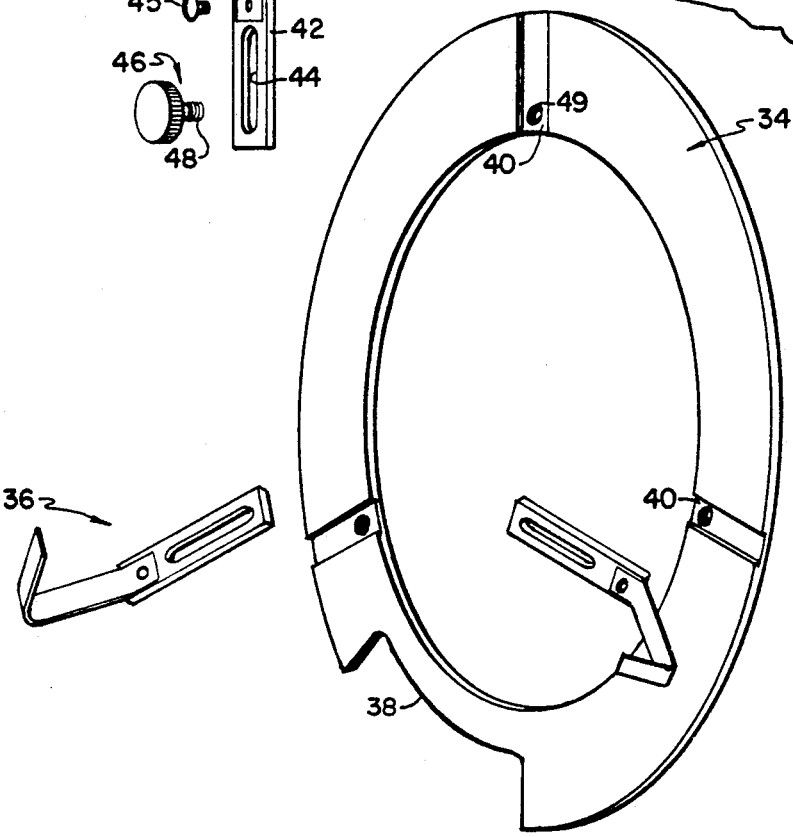
FIG. 3

TECHNIQUE FOR DISPLAYING CUSTOM VEHICULAR WHEELS

This invention relates to a technique for displaying vehicular wheels, particularly those types of wheels known by the generic name of custom wheels, alloy wheels or mag wheels.

Mag wheels are a means of customizing a person's car or truck. Mag wheels were originally available in a few styles for each wheel size. Manufacturers have increased the number of styles available to a point where it is grossly uneconomic for any retailer to keep in stock anything but the best selling wheels.

In addition to inventory for sale, the practice has evolved for the retailer to buy a single wheel of many styles for display. The display wheel is used as a selling tool to sell those wheels not in stock. This reduces the retailer's inventory by 75% when compared to the cost of buying a set of four wheels of every size and style available. One problem with this approach is the retailer ends up with a collection of odd wheels which are unsalable and generally not returnable to the manufacturer as particular wheels go out of production. Another problem is that, even by reducing display inventory by 75%, the amount of money tied up in display wheels is still staggering.

It is known to apply advertising materials to vehicular wheels as shown in U.S. Pat. Nos. 1,481,363; 1,879,761; 1,949,900 and 3,481,652. It is also known to provide renditions of wheels to be placed in the cavity of tires in tire retailing stores to decorate tires available for sale as shown in U.S. Pat. Nos. 2,503,988 and 4,058,917.

This invention comprises an improved technique for displaying custom wheels at a retail store. A series of full size photographs are made of a multiplicity of custom wheels of different style and size. These photographs are taken on the axis of rotation of the wheel being photographed and thus are called axial photographs. The salesman and customer select a few of the photographs of custom wheels. A plurality of connectors are provided for securing the photographs to the wheels of the customer's car. The salesman places the connector on one or more of the wheel-tire assemblies of the customer's car and then secures one of the photographs to the connector. The photograph is full size, is positioned so that the axis of the customer's wheel and the axis of the photograph are coaxial. The photograph thus substantially covers the existing wheel of the customer's car. Several of the photographs are displayed and the customer selects a desired one of the custom wheels. The selected custom wheel is then delivered out of stock or ordered from the distributor/manufacturer if it is not in stock.

This technique allows the custom wheel retailer to stock only sets of wheels which are presently selling well thereby eliminating investment in a large number of wheels which are for display only and which are ultimately unsalable.

In one aspect, this invention comprises a method of displaying a custom wheel on a vehicle having a set of wheel-tire combinations comprising positioning a connector on one of the wheel-tire combinations and placing a photograph of the custom wheel on the connector.

In another aspect, this invention comprises an apparatus for displaying a custom wheel comprising a vehicle having a set of wheel-tire assemblies, a connector on a first of the assemblies and a photograph of a custom wheel attached to the connector and substantially covering the wheel of the first assembly.

It is an object of this invention to provide an improved technique for displaying custom wheels.

Another object of this invention is to provide a series of connectors for temporarily securing photographs of custom wheels onto the wheel-tire assemblies of a customer's car.

Other objects and advantages of this invention will become more fully apparent as this description proceeds, reference being made to the accompanying drawings and appended claims.

IN THE DRAWINGS

FIG. 1 is an isometric view of a wheel-tire assembly equipped with the display device of this invention;

FIG. 2 is a partial cross-sectional view of the assembly of FIG. 1, taken substantially along line 2—2 thereof as viewed in the direction indicated by the arrows;

FIG. 3 is an isometric exploded view of the connector shown in FIGS. 1 and 2, as viewed from the rear or tire side;

Figure 4:
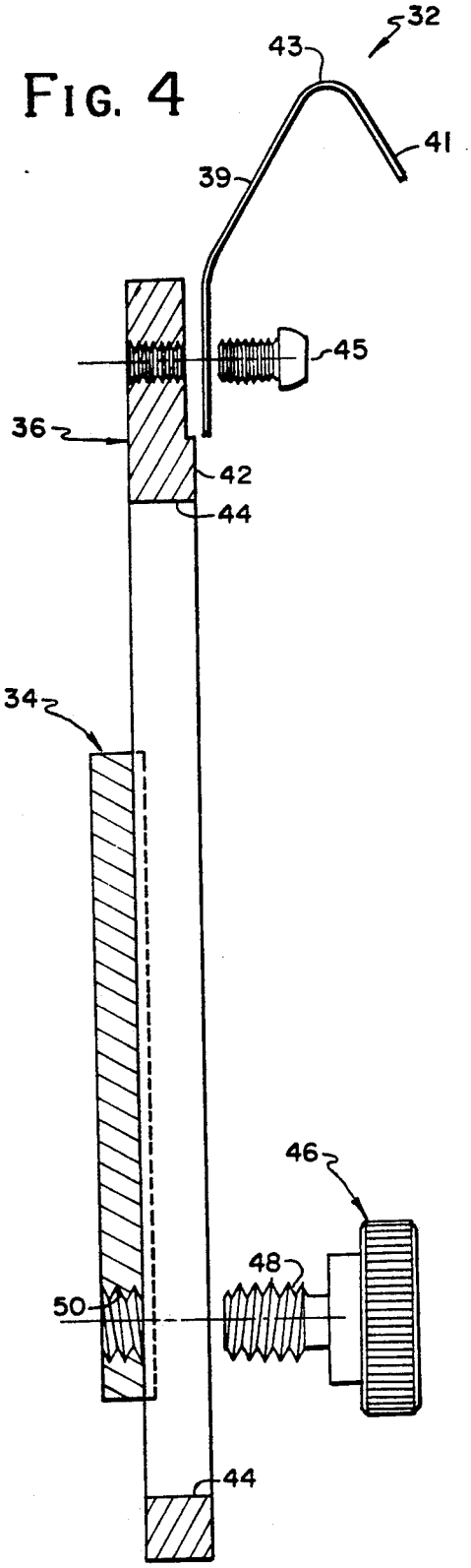
FIG. 4 is an enlarged cross-sectional view of the clips of FIGS. 1-3 and their attachment to the ring.

Referring to FIGS. 1-3, there is illustrated a wheel-tire assembly 10 of a customer's car comprising a conventional steel wheel 12 and a pneumatic tire 14. Wheels 12 of this type are generally symmetrical about a central vertical plane and include a central web 16 and a pair of generally S-shaped outer lips 18 on each side of the tire 14. The inner and outer lips 18 each include an inner annular convex section 20 for receiving a bead 22 of the tire 14. The lips 18 also include an outer annular concave section 24 for purposes more fully apparent hereinafter. The section 20 faces radially away from an axis 26 of the wheel 12 while the concave section 24 faces radially toward the axis 26. The concave section 24 includes an axial outer edge 28 defining a plane perpendicular to the axis 26 and a recess 29 radially outward of the edge 28. A valve stem 30 extends through the web 16 to communicate with the interior of the tire 14 in a conventional manner.

Attached to the wheel 12 and more particularly to the outer lip 18 is a connector 32 comprising a planar annular ring 34 and a multiplicity of clips 36. The ring 34 has an outer diameter smaller than the inner diameter of the edge 28 and preferably smaller than the inner diameter of the concave section 20. A recess or cutout 38 on the outer diameter of the ring 32 provides clearance to avoid the valve stem 30. The ring 34 includes a large central opening because many wheels 12 include central protrusions that extend axially beyond the plane of the lip 28 and thus would interfere with a solid ring. The back, or inside, of the ring 32 provides a plurality of grooves or slots 40 as shown in FIGS. 3 and 4. The clips 36 are positioned in the grooves 40 and accordingly are constrained for radial movement in a predetermined path.

The clips 36 comprise a rail 42 having a central radial slot 44 receiving a threaded connector or thumb screw 46 having a threaded end 48 received in a threaded passage 50 for adjustably clamping the rail 42 to the ring 34. A spring steel finger 39 provides a reverted end 41 and a curved intermediate section 43 received in the groove 29. The finger 39 is connected to the rail 42 by a suitable threaded fastener 45. By providing three clips 36, the connection to the wheel 12 is simple and surprisingly stable.

The radial adjustment allowed by the slot 44 allows the connector 32 to be used on wheels of substantially different size. Thus, FIG. 2 shows the connector 32 used with a small wheel 12, e.g. a 13" rim. By extending the rails 42 as allowed by the slot 44 and thumb wheel 46, the connector 32 can be used on larger sized wheels. It is anticipated that only one size connector 32 is needed for most wheel sizes.

Figure 5:
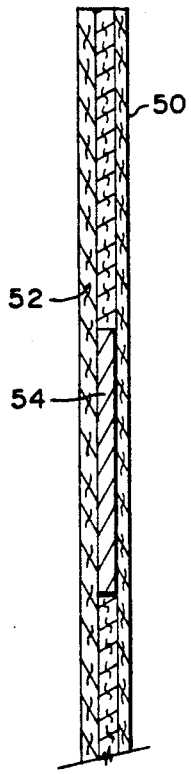
FIG. 5 is an enlarged cross-sectional view of the photograph used in the embodiment of this invention.
Figure 6:
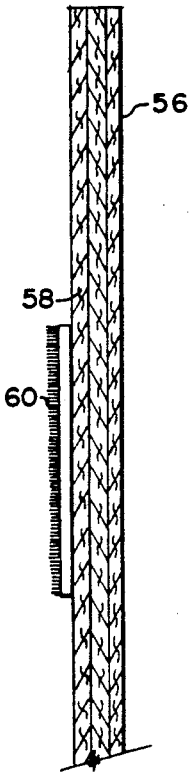
FIG. 6 is an enlarged cross-sectional view of the photograph used in another embodiment of this invention.

A photograph 50 is taken of each of the custom wheels that are desired to be displayed by this invention. The photographs 50 should be axial photographs, i.e. taken from the central axis of rotation of the wheel, so they are circular when trimmed. The photographs 50 are full size and trimmed to the outside diameter of the photographed wheel. The photographs 50 are attached to the ring in a suitable manner with the simulated axis of rotation 51 of the photographed custom wheel substantially coinciding with the axis 26 of the wheel 12. One desirable attachment technique is to make the ring 32 of a magnetizable material, e.g. mild steel, and laminate the photograph 50 to a backing 52 having one or more flat magnets 54 embedded therein as shown in FIG. 5. Another desirable attachment technique is shown in FIG. 6 where the axial photograph 56 is laminated onto a backing 58 having one of a connector pair 60 bonded to the rear face of the backing 58 for connection to the opposite connector pair carried by the ring 34. In the alternative, the photographs may be reproduced, as by lithography or the like, on stock sufficiently heavy as to not require laminating or a backing. Any stock may be coated with a protective material for additional physical strength, photochemical stability and the like. The connector pair may be reusable adhesives, fabric hook and loop arrangements available under the trademark VELCRO, or the like. Because the photograph 50 is substantially the same diameter as the wheel 12 and the axis of the photograph 50 substantially coincides with the axis 26, the photograph substantially covers the wheel 12.

Figure 7:
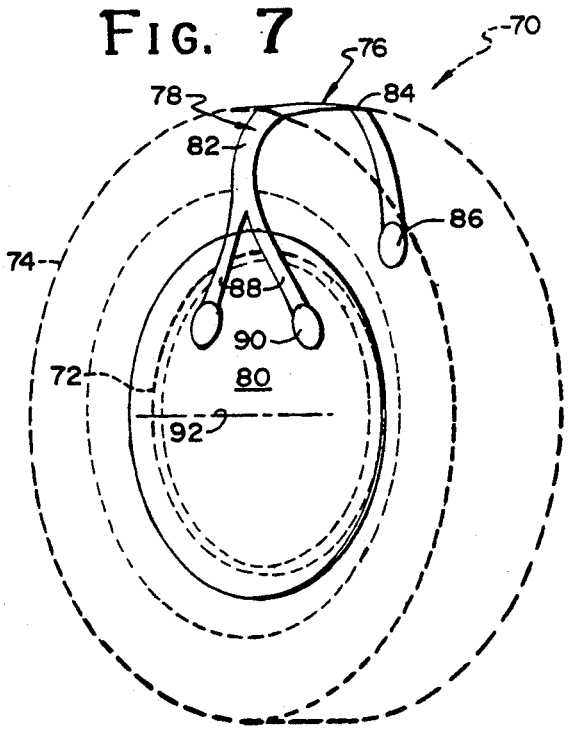
FIG. 7 is an isometric view of another connector of this invention.

Referring to FIG. 7, there is illustrated another embodiment of this invention. A conventional wheel-tire assembly 70 comprises a wheel 72 and a pneumatic tire 74. A display device 76 of this invention comprises a connector 78 on the assembly 70 and a photograph 80 of a custom wheel. The connector 78 comprises a fabric strap 82 having one end 84 extending over the top of the tire 74 providing a weight 86 counterbalancing the weight of the photograph 80. The strap 82 includes a bifurcated end 88 having a connector pad 90 on each end connected to the photograph 80. The connector pad 90 is preferably reusable such as an adhesive or a fabric hook and loop arrangement.

The use of this invention should now be apparent. An axial photograph is taken of many production custom wheels and delivered to the retail outlet along with one or more of the connectors of this invention. The salesman and customer select several of the photographs of wheels which appeal to the customer. In the case of the connector 32, the salesman attaches the clips 36 and ring 34 to one of the customer's wheel-tire assemblies and then attaches a first of the photographs. After consideration by the customer, the salesman removes the first photograph and places a second photograph on the connector 32. This is repeated until the customer decides which of the wheels he wants. In the case of the connector 78, the salesman attaches the photograph 80 to the connector pads 90 and places the strap 82 over the top of the tire, adjusting the position of the photograph 80 so it covers the wheel 72. To look at a second photograph 80, the salesman removes the connector 78 from the tire 74, removes the first photograph and replaces it with a second one and again drapes the connector 78 over the tire 74.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. In combination, a vehicle having a set of wheel-tire assemblies including wheels having an axis of rotation and an annular lip section of a first diameter defining a first plane;

a connector on a first of the assemblies comprising a series of clips extending into engagement with the lip and an annular ring having an outer diameter smaller than the first diameter and attached to the clips and positioned in a plane parallel to the first plane, the clips including a resilient section, a rigid section and means mounting the rigid section on the ring for adjustable radial movement;

a generally circular representation of a custom wheel different than the first wheel having a simulated axis of rotation and an outer diameter substantially the same as the first diameter, the representation being a full size axial representation of the custom wheel viewed perpendicularly to the simulated axis of rotation of the custom wheel and being attached to the connector in a position where the axis of rotation and the simulated axis of rotation substantially coincide thereby substantially covering the wheel of the first assembly; and means connecting the representation to the annular ring.

2. The combination of claim 1 wherein the ring is of a magnetizable metal and the connecting means comprises a plurality of magnets.

3. The combination of claim 1 wherein the connecting mean comprises a plurality of separable fasteners including a plurality of first sections having fabric loops thereon and a plurality of second sections having fabric hooks thereon.

4. The combination of claim 1 wherein the ring is an annular ring providing a large central opening.

5. The combination of claim 1 wherein the wheel-tire assemblies include a valve stem and the ring provides a recess opening into the outer diameter receiving the valve stem therein.

6. The combination of claim 1 further comprising means on the ring constraining the clips for radial movement.

7. The combination of claim 1 wherein the representation is a photograph.

8. Apparatus for displaying a representation of a custom wheel on a vehicular wheel having an axis of rotation comprising a rigid element having an outer edge and a first axis extending therethrough corresponding to the axis of rotation of the vehicular wheel;

a plurality of rigid sections having resilient clips thereon and means mounting the rigid sections on the rigid element for radial adjustable movement relative to the first axis; and a full sized axial representation of a custom wheel and means mounting the representation on the rigid element, the representation being generally circular and having an outer diameter larger than the outer edge of the rigid element.

9. The apparatus of claim 8 wherein the rigid element is a ring of a magnetizable metal and the connecting means comprises a plurality of magnets.

10. The combination of claim 8 further comprising means on the rigid element constraining the rigid sections for radial movement.

11. The combination of claim 8 wherein the connecting means comprises a plurality of separable fasteners including a plurality of first sections having fabric loops thereon and a plurality of second sections having fabric hooks thereon.

12. The combination of claim 8 wherein the outer edge is arcuate.

13. The combination of claim 8 wherein the representation is a photograph.

* * * * *